US005320074A

United States Patent [19]

Schultz et al.

[11] Patent Number: 5,320,074

[45] Date of Patent: Jun. 14, 1994

[54] DIRECT ACTING HYDRAULIC TAPPET

[75] Inventors: Kraig D. Schultz, Jenison; Timothy J. Fullmer, Muskegon; Robert C. Roos, Fruitport, all of Mich.

[73] Assignee: Sealed Power Technologies Limited Partnership, Muskegon, Mich.

[21] Appl. No.: 79,240

[22] Filed: Jun. 17, 1993

[51] Int. Cl.[5] ..... F01L 1/24

[52] U.S. Cl. ..... 123/90.51; 123/90.55; 74/569; 29/888.43

[58] Field of Search ..... 123/90.48, 90.49, 90.51, 123/90.55; 74/569; 29/888.43

[56] References Cited

U.S. PATENT DOCUMENTS

| | | | |
|---|---|---|---|
| 2,925,803 | 2/1960 | Ottestad | 91/396 |
| 3,545,415 | 12/1970 | Mori | 123/90.51 |
| 3,618,575 | 11/1971 | Coates | 123/90.35 |
| 3,657,800 | 4/1972 | Hautala et al. | 123/90.51 |
| 4,270,496 | 6/1981 | Narasimhan | 123/90.51 |
| 4,279,226 | 7/1981 | Lampredi | 123/90.55 |
| 4,367,701 | 1/1983 | Buente | 123/90.55 |
| 4,373,477 | 2/1983 | Buente et al. | 123/90.55 |
| 4,470,381 | 9/1984 | Buente et al. | 123/90.55 |
| 4,590,898 | 5/1986 | Buente | 123/90.55 |
| 4,602,409 | 7/1986 | Schaeffler | 123/90.48 |
| 4,649,875 | 3/1987 | Mirone et al. | 123/90.55 |
| 4,829,950 | 5/1989 | Kamamaru et al. | 123/90.51 |
| 4,909,198 | 3/1990 | Shiraya | 123/90.51 |
| 4,924,825 | 5/1990 | Speil | 123/90.55 |
| 4,993,150 | 2/1991 | Reinhardt | 123/90.51 |
| 4,995,353 | 2/1991 | Stegeman | 123/90.48 |
| 5,060,607 | 10/1991 | Taniguchi | 123/90.51 |
| 5,070,827 | 12/1991 | Krieg et al. | 123/90.48 |
| 5,081,976 | 1/1992 | Dahm et al. | 123/90.55 |
| 5,119,774 | 6/1992 | Krieg et al. | 123/90.55 |
| 5,129,372 | 7/1992 | Seiberth et al. | 123/90.48 |
| 5,168,841 | 12/1992 | Suzuki et al. | 123/90.48 |
| 5,245,958 | 9/1993 | Krieg et al. | 123/90.55 |

OTHER PUBLICATIONS

G. Maas, D. Schmidt, W. Speil, "Performance of Hydraulic Lash Adjusters with Regard to Valve Train Noise at Cold Starts and Short Term Start" 1990 -SAE Technical Paper Series Mar. 1990.

*Primary Examiner*—E. Rollins Cross
*Assistant Examiner*—Weilun Lo
*Attorney, Agent, or Firm*—Barnes, Kisselle, Raisch, Choate, Whittemore & Hulbert

[57] ABSTRACT

A direct acting hydraulic tappet including a one piece body shell having an outer cylinder, an inner cylinder and a plurality of integral axially extending webs that connect the outer cylinder and the inner cylinder. A cam face member is attached to one end of the body. An oil hole extends from the outer surface of the outer cylinder through one of the webs to an inner surface of the inner cylinder. The hydraulic lash compensating unit is positioned in the inner cylinder. The body shell is made from an extruded length of aluminum and is preferably coated with a Teflon impregnated anodized coating. The cam face is made of steel, cast iron or ceramic and is attached to the one end of the body shell by electromagnetic deformation or by the use of adhesive.

12 Claims, 5 Drawing Sheets

DIRECT ACTING HYDRAULIC TAPPET

This invention relates to direct acting hydraulic tappet tappets.

BACKGROUND AND SUMMARY OF THE INVENTION

Existing direct acting tappets consist of an outer cylinder which is held in a bore in the cylinder head. It is contacted on one end by the camshaft and on the other by the valve. It is allowed to slide axially within the bore, translating the rotary motion of the camshaft into axial motion to the valve. The inside of this outer cylinder is large enough in diameter to surround the engine valve spring.

They also contain an inner cylinder which holds a miniature hydraulic lash compensating element. These two cylinders are connected using a radial cross member which is roughly perpendicular to the axis of the cylinder. This cross member effectively closes off the area between the two cylinders on either end. This can be done using one or two pieces, and is normally done using a low cost material.

A wear resistant cap is then affixed to the end of the part facing the camshaft. In some applications the camface is integral with the outer cylinder and the perpendicular cross member is integral with the inner cylinder and is attached to the outer cylinder. In other designs the inner and outer cylinders are integral with an attached camface cap. In other designs the cylinder extends past the perpendicular cross member and captures the cap which is supported on the cross member.

The joining methods for such tappets include welding, brazing, and staking (mechanical deformation). Because of the difficulty in joining steel to aluminum, proposed aluminum designs for this shell have been of the type using a perpendicular cross member which extends between the lash adjuster and the camface. The camface is simply held in place by the outer cylinder and the valve spring preload.

Engine oil is supplied to the hydraulic lash compensating unit through a cavity or reservoir between the outer and inner cylinders. This cavity is bounded by the camface on one end and by the perpendicular cross member on the other. This cavity is filled from a hole in the outer cylinder which is in contact with pressurized engine oil. The outer cylinder is either coated or heat treated to prevent wear from contact with bore in cylinder head.

In such tappets a major disadvantage is that the body of the tappet must be machined or cast in order to provide the perpendicular portion. Other disadvantages of the hydraulic tappets is that they are heavy, costly to manufacture, have multiple pieces, and are noisy in operation.

Among the objectives of the present invention are to provide a direct acting hydraulic tappet and a method of manufacturing which is lighter; lower in cost; easier to manufacture; quiet in stop-start tests; which can use a steel or cast iron camface; and which can be made of aluminum.

In accordance with the invention, a direct acting hydraulic tappet including a one piece body shell having an outer cylinder, an inner cylinder and a plurality of integral axially extending webs that connect the outer cylinder and the inner cylinder. A cam face member is attached to one end of the body. An oil hole extends from the outer surface of the outer cylinder through one of the webs to an inner surface of the inner cylinder. The hydraulic lash compensating unit is positioned in the inner cylinder. The body shell is made from an extruded length of aluminum and is preferably coated with a Teflon impregnated anodized coating. The cam face is made of steel, cast iron or ceramic and is attached to the one end of the body shell by electromagnetic deformation or by the use of adhesive.

DESCRIPTION

Figure 1:
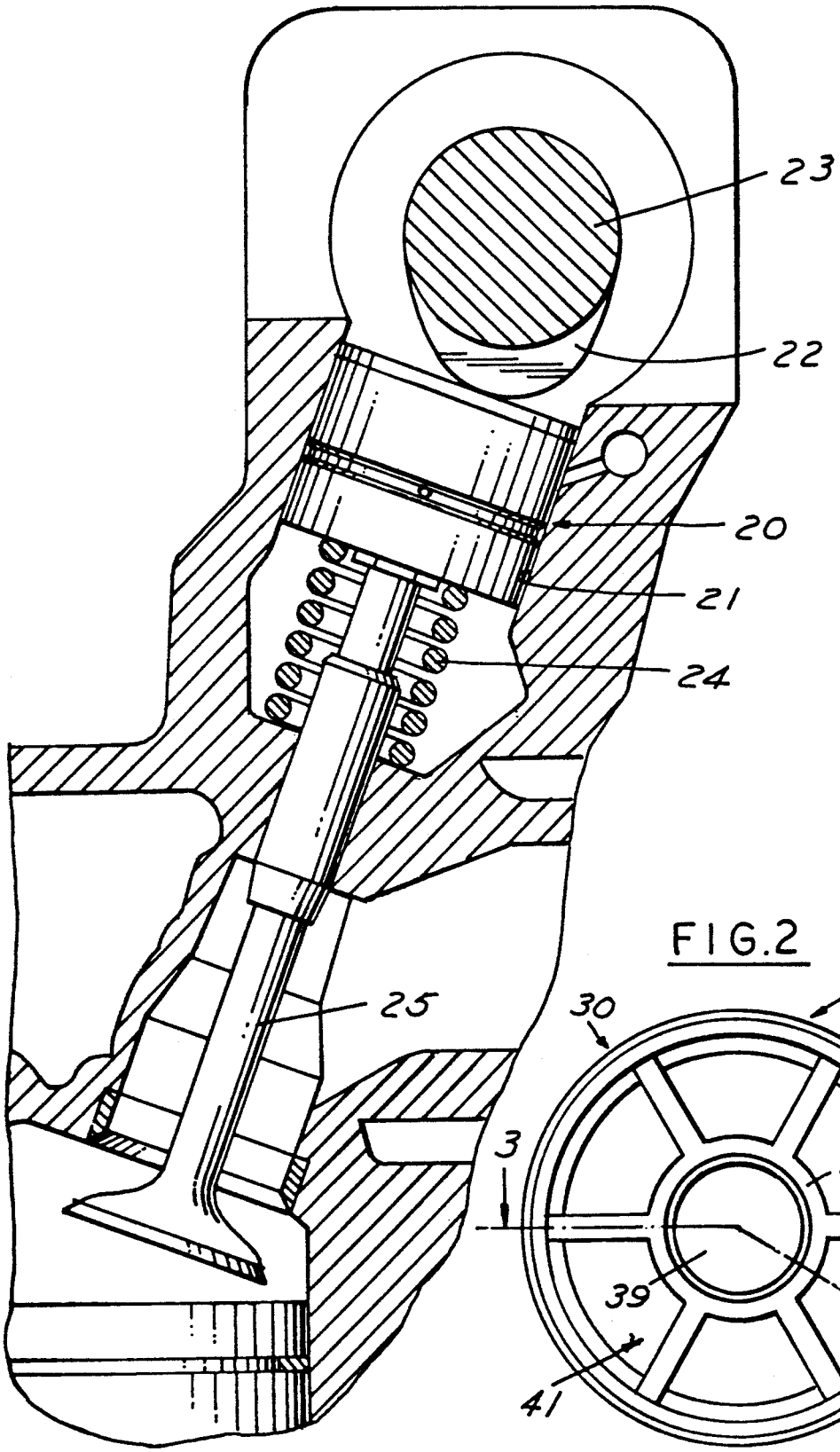
FIG. 1 is a fragmentary cross sectional view of a direct acting hydraulic tappet in an internal combustion engine.
Figure 2:
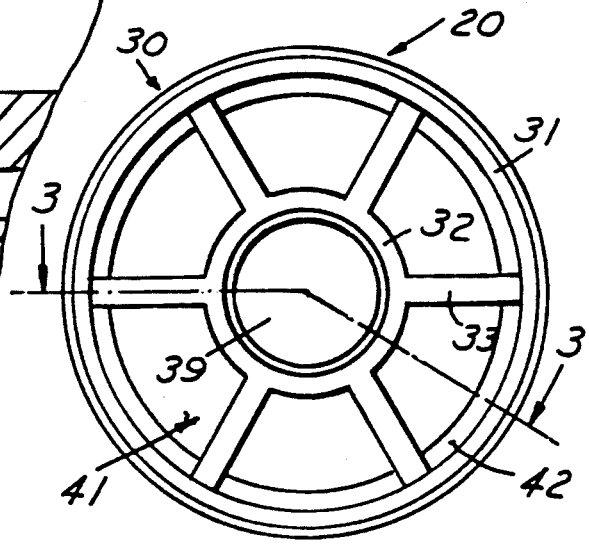
FIG. 2 is a bottom plan view of the tappet.
Figure 3:
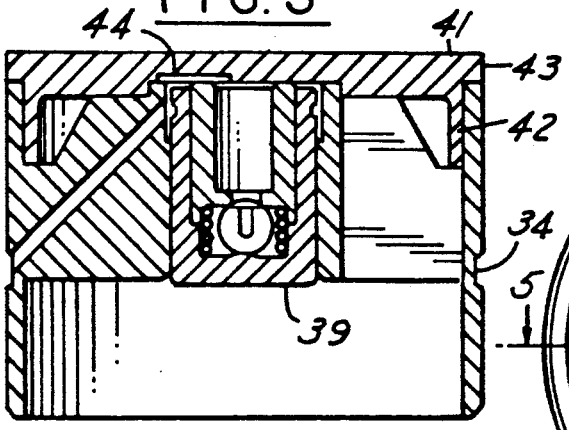
FIG. 3 is a sectional view taken along the line 3—3 in FIG. 2.
Figure 4:
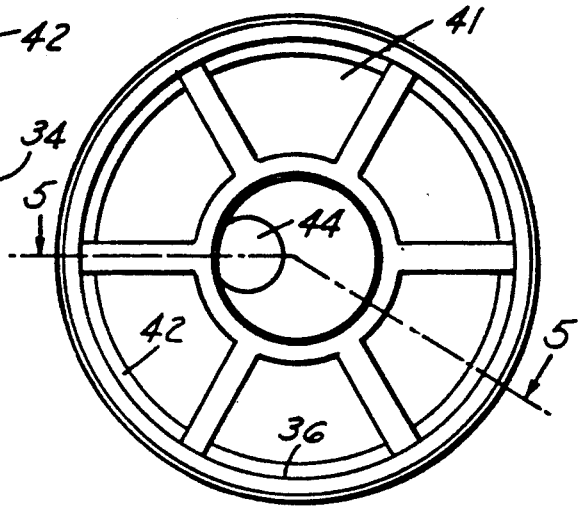
FIG. 4 is a bottom plan view of the tappet with the hydraulic lash compensating unit removed.

Referring to FIGS. 1-7, the direct acting hydraulic tappet 20 embodying the invention is positioned in a bore 21 of an engine for sliding movement axially in the bore 21. The tappet 20 is contacted at one end by a cam 22 on a cam shaft 23. A spring 24 extends into the tappet 20 and yieldingly urges the tappet 20 against cam 22. A valve 25 is operated by the tappet 20, in accordance with conventional construction.

Figure 5:
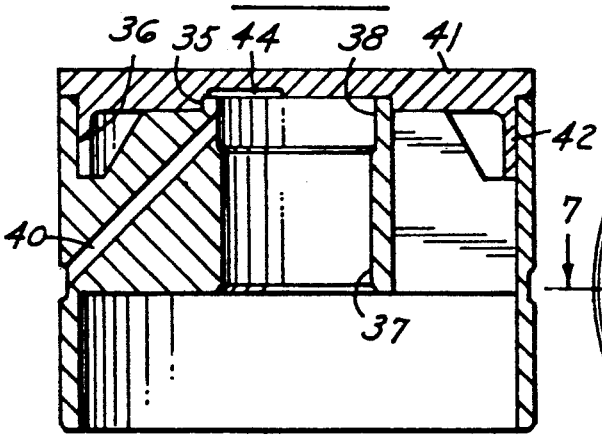
FIG. 5 is a sectional view taken along the line 5—5 in FIG. 4.
Figure 6:
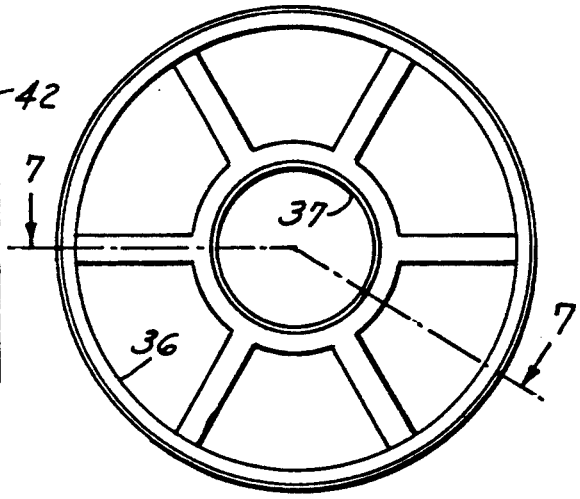
FIG. 6 is a bottom plan view of the tappet shown in FIG. 5 with the cam face member removed.
Figure 7:
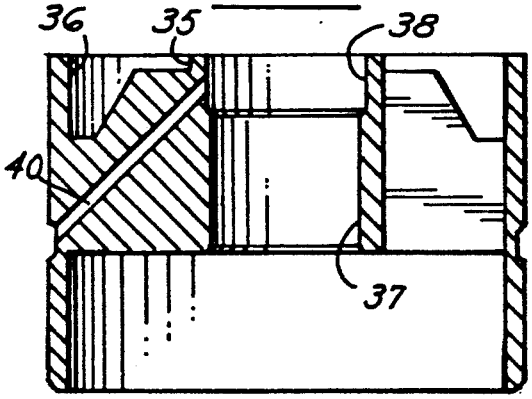
FIG. 7 is a sectional view taken along the line 7—7 in FIG. 6.

The tappet 20 comprises a shell 30 (FIGS. 6, 7) that consists of a one piece extruded body that includes an outer cylinder 31, an inner cylinder 32 and a plurality of axially extending webs 33 integrally connecting the outer cylinder 31 and the inner cylinder 32. Intermediate its ends, the outer cylinder 31 is formed with an annular groove 34. The inner cylinder 32 has a lesser length than the outer cylinder 31. The upper end of each web 33 is machined to form an annular recess 35 adjacent the inner cylinder 32 and a second annular recess 36 of greater axial dimension adjacent the outer cylinder 31. The inner surface 37 of the inner cylinder 32 is formed with a shoulder 38. A hydraulic lash compensating assembly 39 is provided within the inner cylinder 32, as is well known in the art. The shell 30 further includes an oil passage 40 that extends from the groove 34 axially upwardly and inwardly to the upper end of the cavity formed by the inner surface of the cylinder 32 (FIGS. 5, 7).

The hydraulic tappet 20 further includes a camface member 41 on the upper end of shell 30 and has an integral annular axial wall 42 extending into the recess 36 and a radial flange 43 engaging the upper end of the outer cylinder 31. Cam face 41 includes a recess 44 on the underside adjacent the upper end of passage 40.

The camface member 41 is made of hardened steel, cast iron or ceramic and is attached to the body shell 30 by electromagnetic forming, adhesive bonding or both. The shell is preferably made of a lightweight metal such as aluminum.

Figure 8:
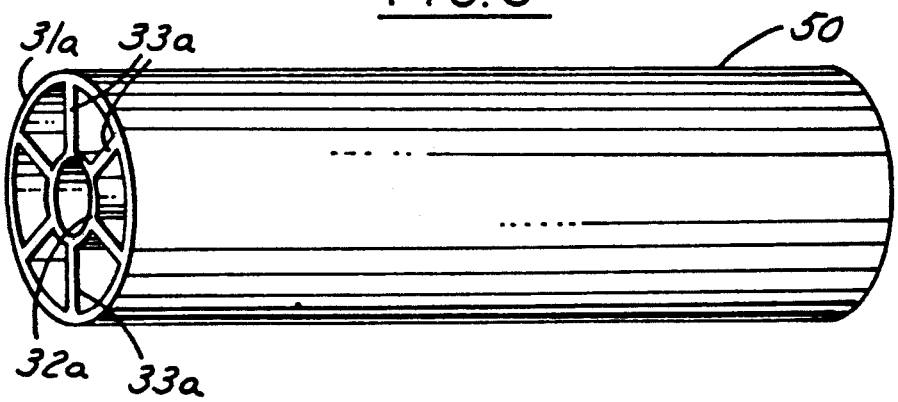
FIG. 8 is a perspective view of an extrusion utilized in making the body shell of the hydraulic tappet.
Figure 9:
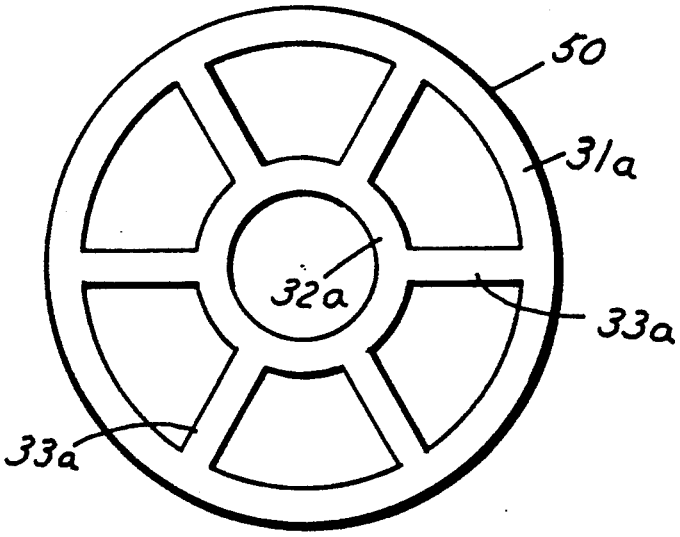
FIG. 9 is an end view of the extrusion shown in FIG. 8.

Referring to FIGS. 8 and 9, the body shell is formed from a bar 50 that is formed by continuous extrusion so that it has an outer cylinder 31*a*, an inner cylinder 32*a* and axial webs 33*a*. The extruded body 50 is cut into lengths and then the body shell is machined from such lengths.

The outer surface of the outer cylinder 31 is preferably anodized with Teflon impregnation, Teflon being a registered trademark of Dupont.

It can thus be seen that there is thus provided a hydraulic tappet which does not utilize a web that extends perpendicular to the axis of the body and which does not require an oil reservoir or cavity in the shell.

Figure 10:
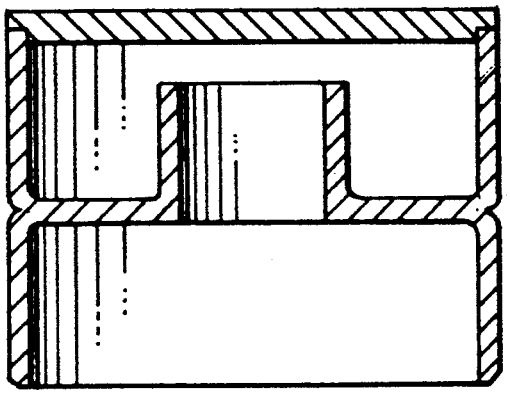
PRIOR ART FIG. 10
FIGS. 10-14 are cross sectional views of prior art hydraulic tappets.
Figure 11:
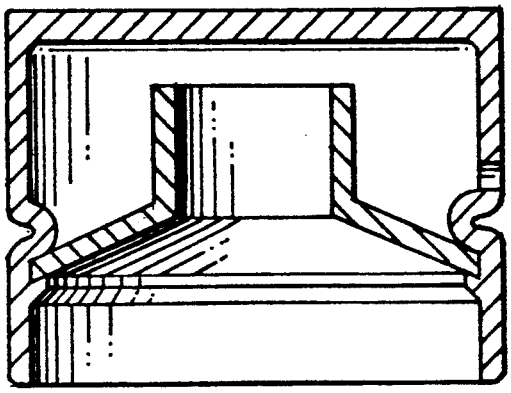
PRIOR ART FIG. 11
Figure 12:
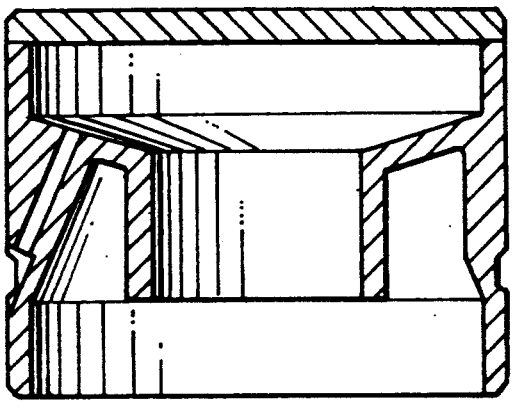
PRIOR ART FIG. 12
Figure 13:
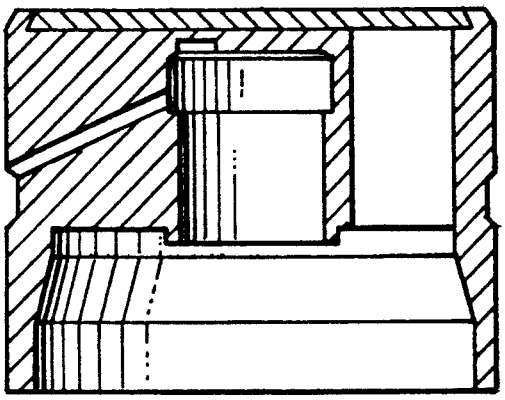
PRIOR ART FIG. 13
Figure 14:
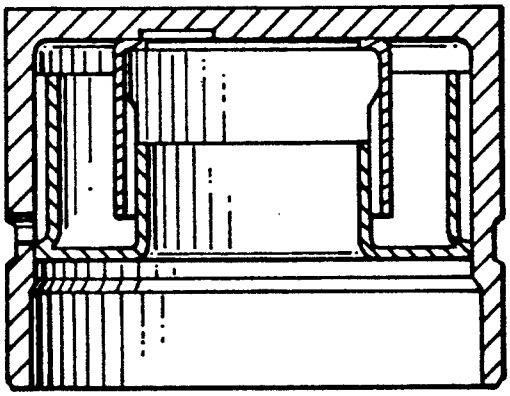
PRIOR ART FIG. 14

FIGS. 10–14 show prior art tappets: FIG. 10 is a drawing of a prior art tappet such as shown in U.S. Pat. Nos. 4,995,353 and 5,119,774 without the foam filling; FIG. 11 is a drawing of the prior art tappet shown in U.S. Pat. No. 4,602,409; FIG. 12 is a drawing of the prior art tappet shown in U.S. Pat. Nos. 4,590,898 and 4,270,496; FIG. 13 is a drawing of a prior art tappet such as shown in U.S. Pat. No. 4,367,701; and FIG. 14 is a drawing of prior art tappet shown in FIG. 11*a* of SAE Technical Paper Series 900451 titled Performance of Hydraulic Lash Adjusters With Regard to Valve Train Noise at Cold Starts and Short Term Start, International Congress and Exposition, Detroit, Mich., Feb. 26–Mar. 2, 1990.

Figure 15:
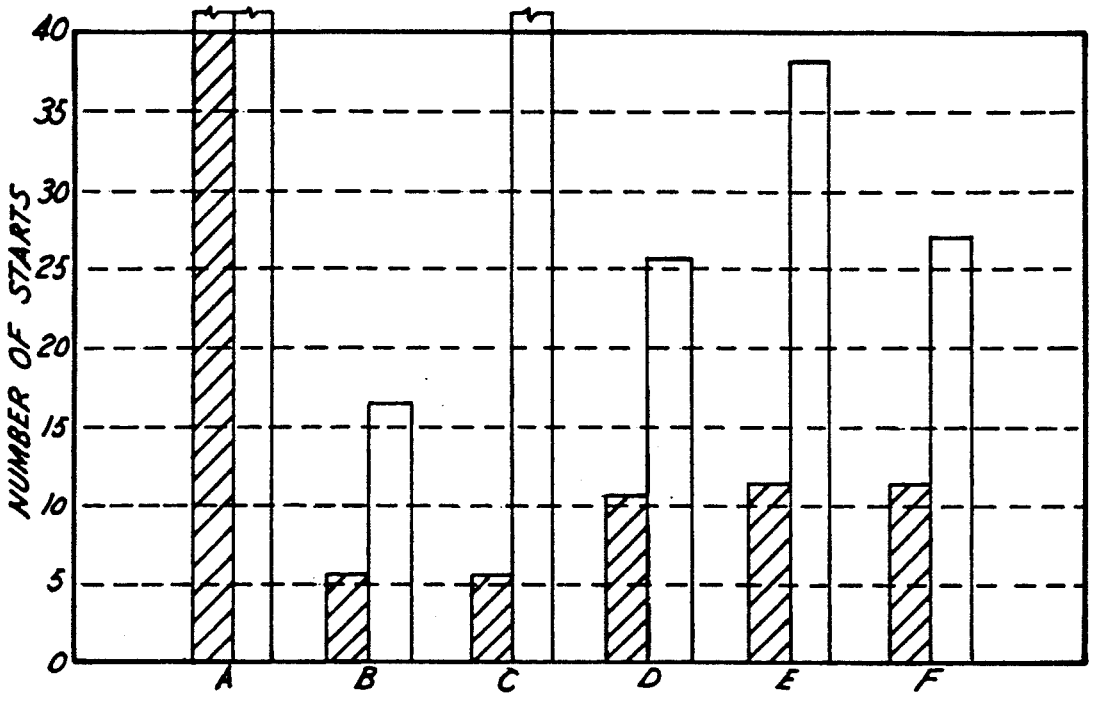
FIG. 15 is a bar chart of the results of starts to noise tests.

FIG. 15 is a comparative summary of Starts to Noise of various tappets wherein:

A is a tappet of the present invention.

B is a tappet shown in FIG. 11.

C is tappet shown in FIG. 14.

D, E are tappets shown in FIG. 12.

F is tappet shown in FIG. 10.

These tests used the following procedure:

1. Warm engine: 90° C.
2. Let engine sit: 20 min.
3. Start engine and run for: 5 sec.
4. Let engine sit: 20 min.
5. Repeat steps 3 and 4 for: 40 starts
6. Record for the start number when noise first occurs, and when the engine fails to quiet during the run time.

In FIG. 15, the clear bar represents the start number when the engine failed to quiet within the 5 second duration of the test. The cross hatched bar indicates the start number when noise was first noticed, but the engine did quiet during the 5 seconds.

It can be sen that the tappet embodying the invention exceeded 40 starts.

Figure 16:
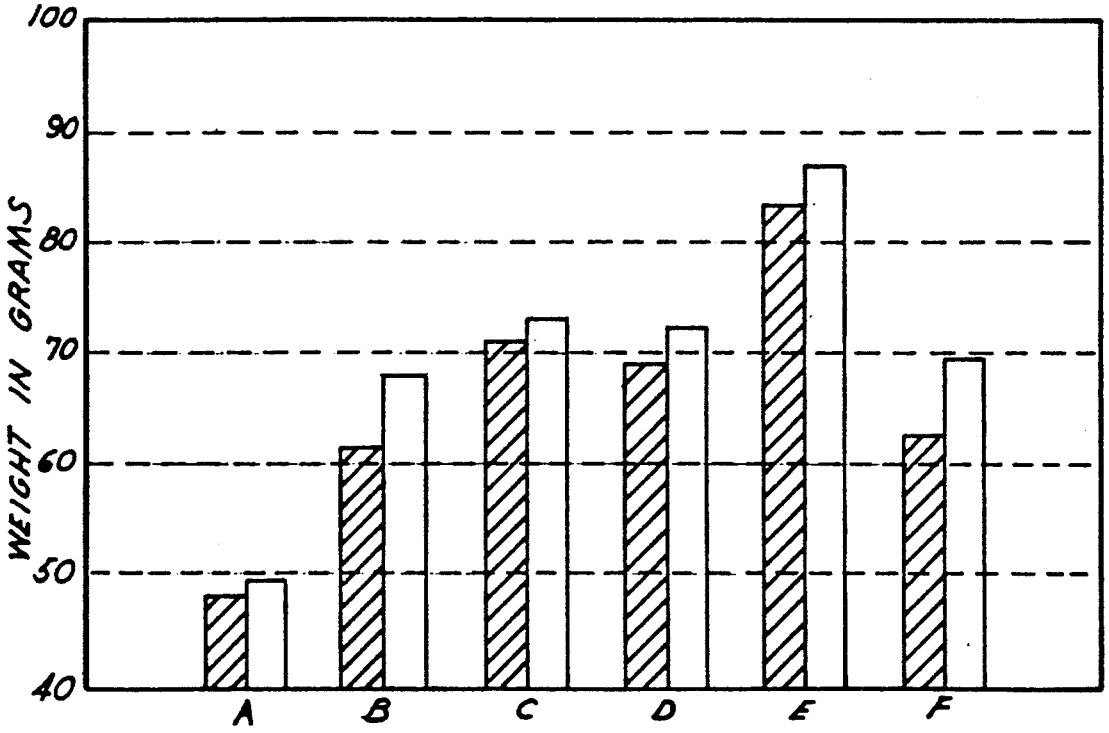
FIG. 16 is a bar chart of weight tests.

FIG. 16 is a graphic summary of comparative weight tests of these tappets.

In FIG. 16, the clear bar indicates the weight of the tappet when filled with engine oil. The cross hatched bar is the weight of the tappet when empty.

It can be seen that the tappet embodying the invention has the least weight.

Referring to FIGS. 10–16 it can be seen that each of the prior art designs has a shell defining a reservoir and having a transverse or radial wall perpendicular to the axis of the shell.

The disadvantage of existing designs is that the rough shape of the part must be machined or formed, one piece at a time. The new design in accordance with the present invention eliminates the perpendicular (radial) cross member and replaces it with cross members or webs that are parallel (axial) with respect to the inner cylinder and outer cylinder leaving both ends of the part open. This allows the basic form of this part to be continuously extruded in bar form. This significantly reduces the cost of manufacturing this part.

The wear resistant camface is then attached using an innovative attachment method. Current methods of attachment include welding, brazing or capturing the camface within the outer cylinder and supporting it on the perpendicular cross member. This new method of the present invention uses electromagnetic forming and/or adhesive bonding to attach the cap to the cylinder. This allows attaching an aluminum housing directly to a wear resistant steel or cast iron cap without the perpendicular cross member between the cap and the hydraulic element. This reduces both the height and weight of the tappet. Reduced tappet height in this type of application directly reduces the overall engine height which allows for a more aerodynamic hood shape. The lighter weight allows for higher engine RPM's due to less reciprocating mass.

The oil is supplied directly to the hydraulic element through a hole 40 in one or more of the axial cross member or webs 33. This eliminates the need for a cavity or reservoir in the shell. This further reduces the operational weight of the tappet. It also reduces the start up noise of the tappet. In current designs, the reservoir drains when the engine is shut off, this reservoir must refill before oil can reach the hydraulic element. In this design of the present invention, there is no reservoir to refill, so oil is supplied much more quickly to the lash element.

The outside surface of the outer cylinder of the present invention uses a novel coating, namely, Teflon impregnation during the anodizing process is used to reduce friction and wear of this surface.

It has been found that the hydraulic tappet embodying the invention is less costly to manufacture; has less weight; easier to manufacture and is very quiet in start-stop tests.

We claim:

1. A direct acting hydraulic tappet for an internal combustion engine including a one piece body shell having an outer cylinder, an inner cylinder and a plurality of integral extending webs that connect the outer cylinder and the inner cylinder and extend lengthwise in a direction of the axis of the body shell, a camface is attached to one end of the body, an oil hole extending from the outer surface of the outer cylinder through one of the webs to an inner surface of the inner cylinder, a hydraulic lash compensating unit is positioned in the inner cylinder, and the body shell comprises an extruded length of aluminum.

2. The hydraulic tappet set forth in claim 1 wherein said webs are flat.

3. The hydraulic tappet set forth in claim 1 wherein said camface member is adhered to said body shell.

4. The hydraulic tappet set forth in claim 1 wherein said outer cylinder has an outer surface which is anodized and impreganted with polytetrafluoroethylene.

5. The hydraulic tappet set forth in claim 1 wherein said camface member comprises hardened steel.

6. The hydraulic tappet set forth in claim 1 wherein said camface member comprises cast iron.

7. The hydraulic tappet set forth in claim 1 wherein said camface member comprises ceramic.

8. The hydraulic tappet set forth in claim 1 wherein said camface member is joined to said body by electromagnetic deformation formed on said body shell.

9. A method of forming a hydraulic tappet for an internal combustion engine which comprises extruding a body having a cross section defining an outer cylinder, an inner cylinder and integral webs extending lengthwise in an axial direction of said body, serving a portion of the body to define a tappet body shell, bonding a camface member on said body, and forming an oil hole extending from the periphery of the outer cylinder to the inner surface of the inner cylinder.

10. The method set forth in claim 9 including the step of attaching a camface member to one end of said body shell.

11. The method set forth in claim 10 wherein the step of attaching said camface member is by electromagnetic forming.

12. The method set forth in claim 10 wherein the step of attaching said camface member to said body shell is by adhesively bonding the camface member to the shell.

* * * * *